US007059559B2

(12) United States Patent
Furrer

(10) Patent No.: US 7,059,559 B2
(45) Date of Patent: Jun. 13, 2006

(54) DEVICE FOR SUPPORTING A WEB AND DEVICE AND PROCESS FOR REMOVING A WEB FROM AN AXLE

(75) Inventor: Hans Furrer, Uttigen (CH)

(73) Assignee: Maschinenfabrik WIFAG, Bern (CH)

( * ) Notice: Subject to any disclaimer, the term of this patent is extended or adjusted under 35 U.S.C. 154(b) by 160 days.

(21) Appl. No.: 10/704,174

(22) Filed: Nov. 6, 2003

(65) Prior Publication Data

US 2004/0113010 A1 Jun. 17, 2004

(51) Int. Cl.
*B65H 16/02* (2006.01)

(52) U.S. Cl. ..... 242/595; 248/619; 414/911

(58) Field of Classification Search ..... 242/533, 242/558, 559, 595; 414/911; 248/619, 620

See application file for complete search history.

(56) References Cited

U.S. PATENT DOCUMENTS

| | | | |
|---|---|---|---|
| 5,402,980 A | 4/1995 | Gray et al. | |
| 6,176,670 B1 * | 1/2001 | Salsburg | 414/391 |
| 2003/0133781 A1 | 7/2003 | Lehrieder et al. | |

FOREIGN PATENT DOCUMENTS

| | | |
|---|---|---|
| DE | 43 34 582 | 4/1995 |
| DE | 197 14 551 | 10/1998 |
| DE | 299 08 233 U1 | 10/1999 |
| DE | 100 20 909 A1 | 11/2001 |

* cited by examiner

*Primary Examiner*—John Q. Nguyen
(74) *Attorney, Agent, or Firm*—McGlew & Tuttle, P.C.

(57) ABSTRACT

A device for supporting a web with a holding device (5), a first spring element (14), which generates a first spring force directed roughly against the force caused by the load in case of a loading of the holding device (5) and with a second spring element (16), which generates a second spring force acting roughly in the direction of the force caused by the loading of the holding device (5).

8 Claims, 4 Drawing Sheets

DEVICE FOR SUPPORTING A WEB AND DEVICE AND PROCESS FOR REMOVING A WEB FROM AN AXLE

FIELD OF THE INVENTION

The present invention pertains to a device for supporting a web, e.g., a web of paper, which can be used, e.g., in a web changer of a web-fed printing press. Moreover, the present invention pertains to a device and a process for removing such a web from an axle.

BACKGROUND OF THE INVENTION

When depositing a web, e.g., from the supporting arms of a web changer onto a shifting platform, relatively high forces may arise, which may lead to a destruction of parts of the web changer or of the shifting platform. As an example, FIG. 1 shows a web changer 1, which holds webs of paper 6 and 7 via the supporting pins 1*a* and 1*b*. To change a web of paper, e.g., a full web of paper 6 is brought to the web changer 1 via a shifting platform 3 and is picked up by the web changer 1 and is pivoted by means of the supporting pin 1*a*, whereby a web 7, which is to be changed and is, e.g., almost completely unwound, is again deposited on the shifting platform 3. If the angle w during the depositing and removal from the axle of this web of paper 6 on the holding device 5 of the shifting platform 3 is relatively small and lies, e.g., in the range of 0 to 15 degrees, then forces may arise which would destroy parts of the web changer 1 as well as of the shifting platform, especially if the shifting platform 3 is not spring-loaded and the drive motor of the supporting arm 2 pivots with a large torque.

A web changer, with which a web of paper can be unloaded via a shifting platform, is known from DE 43 34 582 A1. With this, a measuring device is needed in the web changer, with which the web velocity of the web of paper running off and the angular velocity of the web of paper, from which this web is unwound, can be measured, so that the diameter of the web of paper can be determined as a quotient of the web velocity and the angular velocity, from which the angle and the distance, under which the shifting platform picks up the web of paper, are determined.

DE 197 14 551 C2 describes a device for removing a web of printed matter from supporting arms of a web changer in a web-fed printing press with a holding device, onto which the web of printed matter can be deposited, whereby on the holding device there is provided a pressure sensor for detecting the weight and pressure exerted by the web of printed matter and the supporting arms on the holding device. A calculation setup of a control circuit determines the difference between an actual pressure value detected by the pressure sensor and a residual web pressure value of the web of printed matter to be changed, which was calculated or predetermined beforehand. The lowering of the supporting arms is stopped via the control circuit, if the pressure which is applied to the holding device within a predetermined bandwidth corresponds to the amount of the weight of the web of printed matter to be deposited, whereupon the tensioning spindles of the supporting arms, released by the weight of the web of printed matter, can be pulled out.

However, if no or false signals are issued by a measuring instrument or such a pressure sensor, since no reliable information is present, e.g., because of a web tear or emergency switching off, then there may yet be high reaction forces on the shifting platform when removing a web of printed matter, as a result of which, on the one hand, parts of the web changer and, on the other hand, the shifting platform may be damaged or even destroyed.

SUMMARY OF THE INVENTION

The object of the present invention is to provide a device for supporting a web, as well as a device and a process for removing a web from an axle, which make possible the safe and destruction-free depositing of a web.

The device according to the present invention for supporting a web, e.g., a web of printed matter or a web of paper, has a holding device, onto which the web can be deposited. According to the present invention, a first spring element is provided, which is connected or coupled with the holding device such that, when the holding device is loaded, e.g., by depositing the web, a first spring force that is directed roughly against the force caused by the load is generated by the first spring element. Moreover, according to the present invention, a second spring element is provided, which is coupled or connected with the holding device such that the second spring element generates a second spring force acting roughly against the force generated by the first spring element. Preferably, the second spring force acts roughly in the direction of the force caused by the load. As a result, the first spring element provided for generating a counterforce when depositing a web on the holding device can be made "soft" via a predetermined spring stroke, i.e., the total system formed by the first and second spring elements has a spring extension constant that is formed by a cooperation of the first and the second spring elements, as a result of which desired spring forces can be set within predetermined spring strokes that can be varied with the spring stroke or depending on a movement of the holding device. Preferably, the first and/or second spring element is attached to a device that is stationary itself or is connected to or stands on a stationary device, e.g., a floor. The stationary device should advantageously not move with the web to be deposited.

Advantageously, the first and second spring elements are designed or arranged so that the maximum spring stroke of the second spring element is smaller than a maximum attainable spring stroke of the first spring element. E.g., the spring elements can be arranged such that the first spring element is compressed by a pressure force that is caused by a web deposited on the holding device, whereas the second spring element, which is tensioned in the resting state with the absence of a load on the holding device, e.g., by the force of the first spring element, is gradually released with a movement caused by a loading of the holding device.

The second spring element may be designed such that, after a predetermined spring stroke or after a lowering of the holding device, the second spring element is completely released, such that force is no longer acted on the holding device by the second spring element, as a result of which the holding device is only still sprung by the first spring element after the predetermined spring stroke. In case of such an arrangement of the first and second spring elements, a loading of the holding device first leads, via a predetermined spring stroke of, e.g., 5 mm, after which the second spring element is then completely released, to a lowering of the holding device caused by the load with a lower spring force counteracting the load, after which a higher spring force acts on the holding device after the complete release of the second spring element, to make difficult a further lowering or springing in of the holding device after the predetermined spring stroke. Thus, a stop signal for the web changer can be generated, e.g., via a switch or initiator, which is triggered by a movement or lowering of the holding device, e.g., after a predetermined stroke, whereby the moving or lowering of the holding device needed for triggering the switch or initiator takes place relatively easily against a lower spring force, while a higher spring force counteracts a further movement or lowering of the holding device, so that a "repivoting" of a supporting arm of the web changer can be done without problems with a web held by the supporting arm.

In the resting state, the spring force of the partly tensioned first spring element is preferably higher than the spring force of the partly tensioned second spring element, so that, e.g., the second spring element in the resting position can be tensioned by the first spring element in the absence of a load on the holding device and makes the first spring element "soft" via a predeterminable spring stroke. The spring constant of the first spring element may be greater than, equal to or smaller than that of the second spring element.

The resting state may be, e.g., a state, in which the supporting device is unloaded. Individual or all spring elements may be released or partly or completely tensioned.

Preferably, the first spring element is a compression spring, a set of compression springs or even an arrangement comprising a plurality of compression springs, which generates a counterforce when compressing the spring or spring elements. Advantageously, the second spring element is embodied as a plate spring or a set of plate springs, which have a preferably relatively small spring stroke of, e.g., 1 to 10 mm, especially 5 mm, until the plate spring or the set of plate springs is completely released. In general, the first spring element and/or the second spring element may consist of an individual spring and of spring elements arranged parallel to one another and/or behind one another, whereby here they are described by the terms first and second spring elements for simplification of the present invention. It is also possible to design the device according to the present invention such that the first spring element is released when the holding device is loaded and the second spring element is tensioned, as a result of which the same effects can be achieved, in principle.

Advantageously, a switching mechanism is provided, which issues a signal when the holding device is brought from the resting position by a predetermined path or is pressed downwards by depositing a web. Such a signal of the switching mechanism may be used, e.g., for stopping the movement of the supporting arm of a web changer. If the switching mechanism is arranged so that it is triggered within the spring stroke, in which the second spring element still generates a force directed against the first spring element, then the triggering of the switching mechanism, e.g., to stop the movement of the web changer, can be brought about by a comparatively low force which acts on the holding device, while the first spring element, no longer made "soft" by the second spring element after a predetermined spring stroke, counteracts a too strong springing in of the holding device.

According to another aspect, at least one spring element may be provided with a spring constant that varies over the spring stroke, which is used instead of and/or in combination with the first and/or the second spring element, so that the effect according to the present invention of a first "soft" and then "hard" spring can be achieved with only a single or a plurality of such spring elements.

According to another aspect, the present invention pertains to a conveying device with a device for supporting a web as described above and at least one conveying element, e.g., a wheel, in order to be able to move the conveying device with or without a web deposited on the holding device, as a result of which a web can be brought to a web changer or conveyed away from same.

Advantageously, the conveying device is equipped such that the first spring element is arranged so as to produce a spring action or spring force between the holding device and the conveying element. A web deposited on the holding device can thus be cushioned by the first spring element, as a result of which an impact which possibly occurs when depositing the web or a higher force does not act directly on the conveying element, but is cushioned. Advantageously, the second spring element is arranged such that a spring force is generated between the conveying element and a spring column connected with the holding device, such that the second spring element counteracts the first spring element, in order to make the first spring element "soft" via a predetermined spring stroke.

According to another aspect, the present invention pertains to a device for removing a web from the axle with a device for supporting a web as described above and especially with a conveying device and a web changer with supporting arms as described above, on which webs can be picked up via supporting pins and can be deposited again by removing from the axle.

Furthermore, the present invention pertains to a process for removing a web from the axle, in which case a holding device is moved by depositing a web against the force of a first spring element and supported by the force of a second spring element and the holding device is only moved against the force of the first spring element after a predetermined spring stroke.

In the process, a switching signal is advantageously generated by a movement of the holding device, preferably in the range of the spring stroke in which the second spring element still exerts a force on the holding device, whereby the switching signal can be used to control a web changer.

The present invention will be described below based on preferred embodiments. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
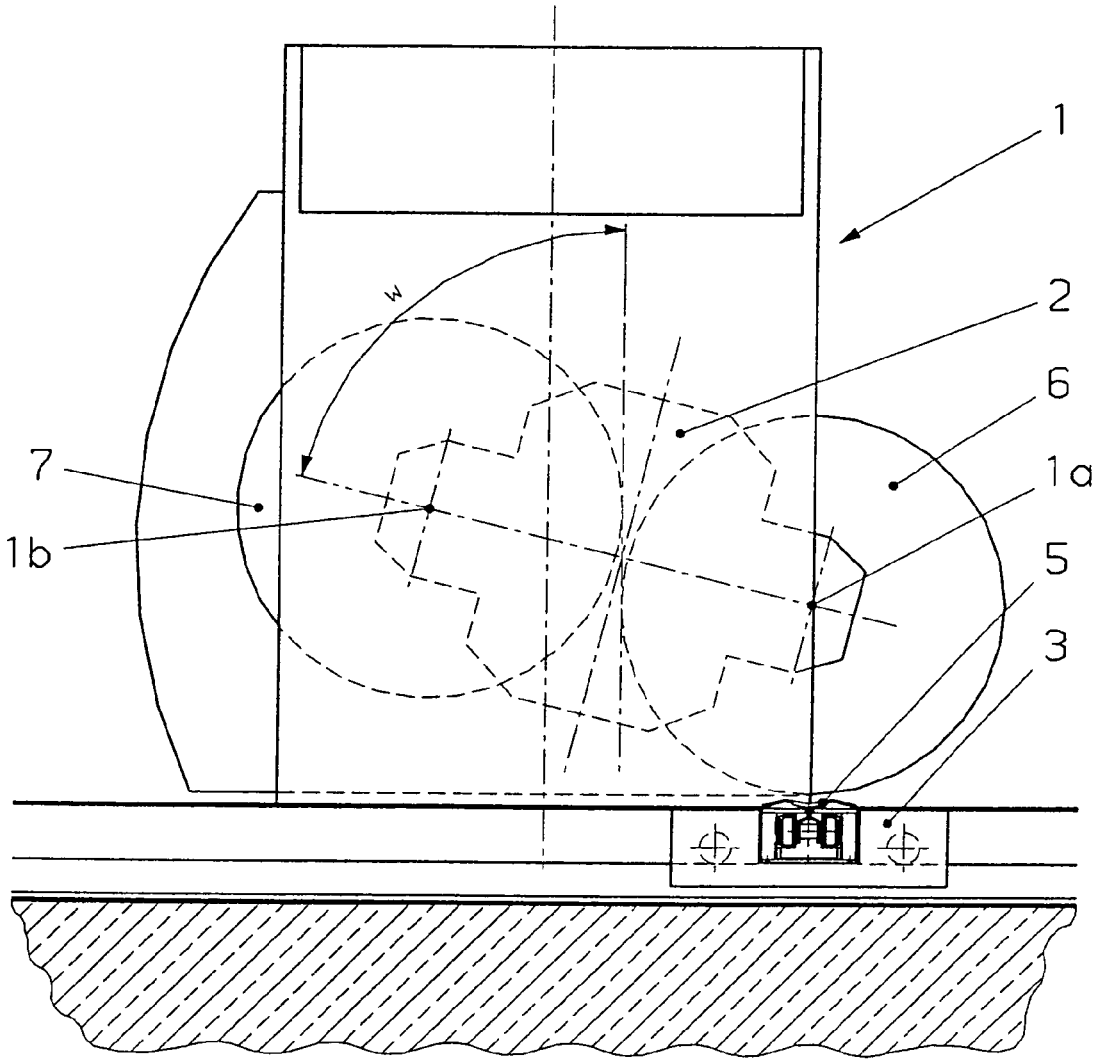
FIG. 1 is side view of a web changer with a conveying device according to the present invention.

Referring to the drawings in particular, FIG. 1 shows a web changer 1 with a supporting arm 2, to which are attached webs of paper 6 and 7 via supporting pins 1*a* and 1*b*. In case of a web change in a web-fed printing press, the supporting arm 2 is pivoted and should be stopped, when the web of paper 6 lies on the holding device 5 of the shifting platform 3. The web of paper 6 presses onto the holding device 5, which is fastened to a spring-loaded frame.

Figure 2:
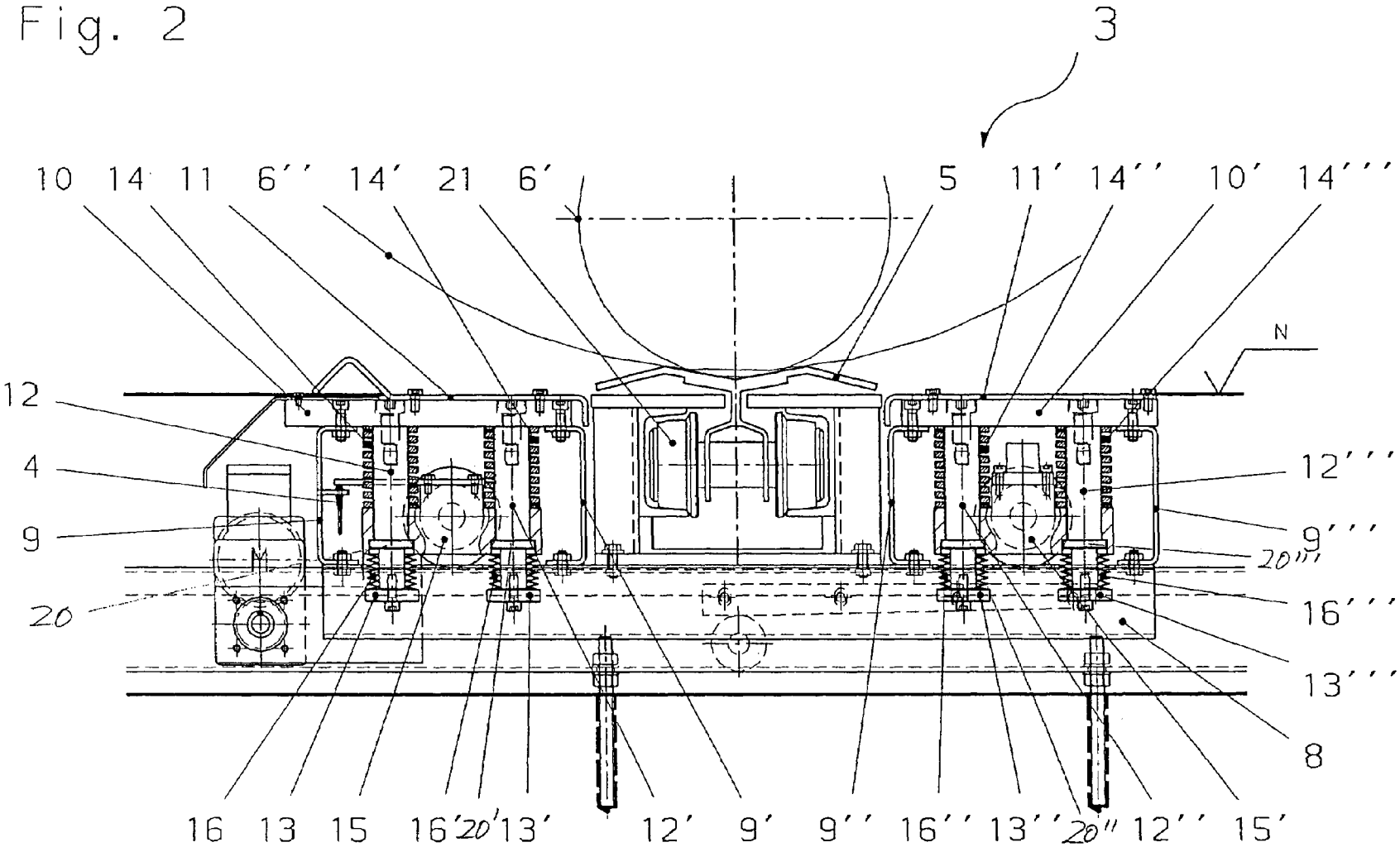
FIG. 2 is an enlarged view of the conveying device shown in FIG. 1.

FIG. 2 shows a detailed view of the shifting platform 3 shown in FIG. 1 and shows that the web of paper 6 is placed onto the holding device 5. The holding device 5 is fastened to a spring-loaded frame, which comprises the longitudinal beams 8, the crossbeams 9, the plates 10, the cover sheets 11, the spring columns 12 and the disks 13 connected to the spring columns 12. For simplification, the forces occurring in the area of a spring column 12 are described below. By depositing the web of paper 6 onto the holding device 5, the moving mechanism 21 connected to the holding device 5, which is used to convey the web of paper 6 out of the plane of projection, is pressed downwards together with the longitudinal beam 8, the crossbeam 9 connected to the longitudinal beam 8 and the plate 10 connected thereto, and thus brings about a compression of the compression spring elements 14 between the plate 10 and the axle element 15. The cover plate 11, whose upper edge is located in the resting position on the level of the precast floor N, is arranged on the plate 10. The plate 10 is connected to the spring column 12, which can be shifted through the axle element 15. On the side of the axle element 15 opposite the compression spring 14, a set of plate springs 16 is arranged between the disk 13 connected to the spring column 12 and the axle element 15, which presses the spring column 12 downwards against the force of the compression spring 14. As long as the set of plate springs 16 is not completely released, the compression spring 14 is made "soft," so that the holding device 5 can be pressed downwards relatively easily for a certain distance by the maximum spring stroke of the set of plate springs 16, before the set of plate springs 16 is completely released and the compression spring 14 without the counterforce of the set of plate springs 16 more strongly counteracts a further pressing in of the holding device 5.

The geometry and the force of the compression springs 14, as well as of the set of plate springs 16 are preferably designed such that, in the resting position, i.e., without a weight lying on the holding device 5, the collar 20 of the spring column 12 rests on the axle element 15. The pressing force between the collar 20 of the spring column 12 and the axle 15 is relatively low in the position of resting.

If the supporting arm 2 of the web changer 1 shown in FIG. 1 pivots with the web of paper 6 on the holding device 5 or on another position of the shifting platform 3, then it springs in. The switch 4, with suitable design, sends a signal after a few tenths of a millimeter to stop the rotary movement of the supporting arm 2. The pressing force between the holding device 5 and the web of paper 6 quickly increases, because the spring force of the compression spring 14 continues to increase, but the spring force of the set of plate springs 16 decreases, as will be described below on the basis of the diagram shown in FIG. 4. After springing in for a few millimeters, the set of plate springs 16 is completely released and therefore no longer has any effect on the entire system. It is expedient to design the spring stroke, such that, after a stop signal has been issued by the switch 4, a "repivoting" of the supporting arm 2 with tensioned web of paper can be performed without any problems by the device shown.

Figure 3:
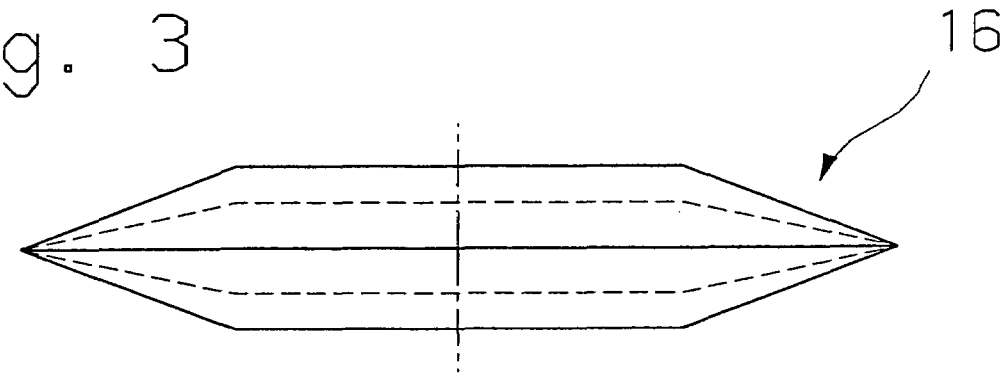
FIG. 3 is a schematic view showing a set of plate springs that can be used for the conveying device.

FIG. 3 shows schematically a cross section of the set of plate springs 16 shown in FIG. 2 based on a preferred embodiment. In this case, two approximately circular-shaped plate springs lie on one another, such that their outer radii touch. The dash-dot lines in FIG. 3 show the tensioned state of the set of plate springs, which changes to the released state shown by solid line after depositing the web of paper 6 onto the holding device 5, in which the set of plate springs no longer exerts force on the disk 13 of the spring column 12.

Figure 4:
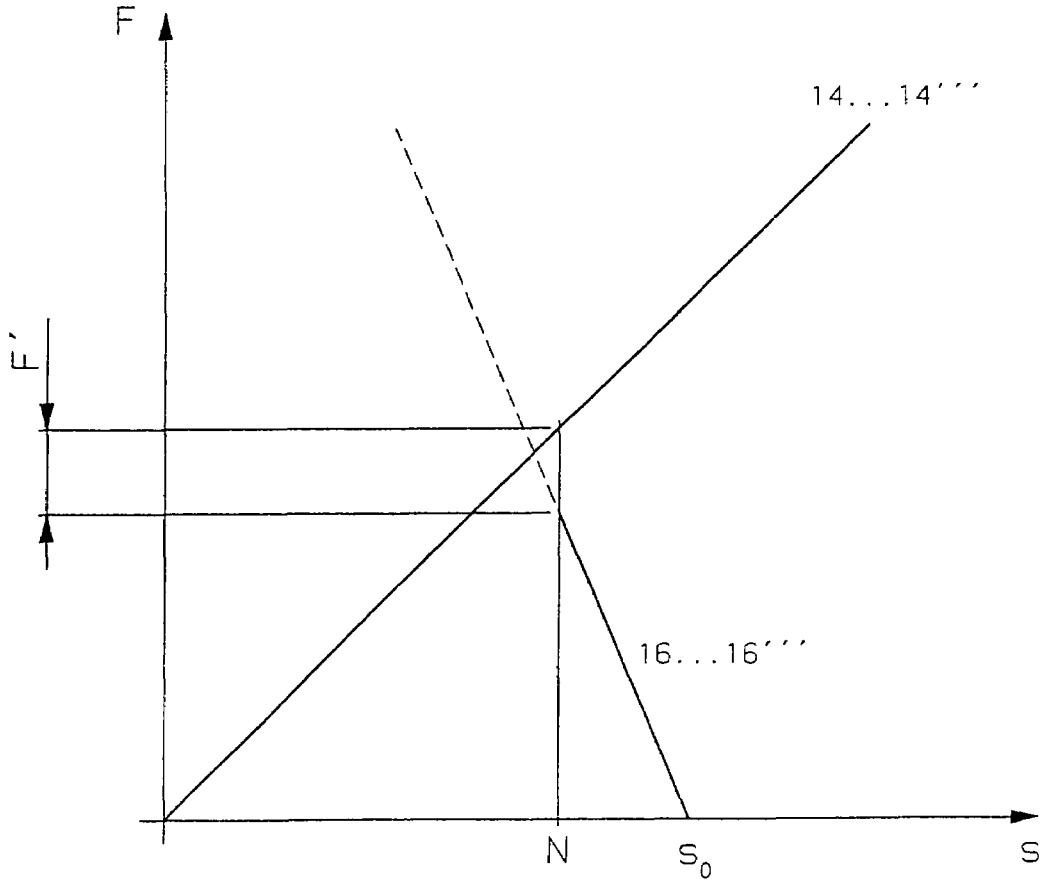
FIG. 4 is a diagram for illustrating the impact force between the axle and the collar of the spring column.

FIG. 4 is a diagram and shows the impact force F' between the axle element 15 and the collar 20 of the spring column 12. The solid, ascending line shows the force generated by the compression spring 14 as a function of the spring stroke s. The descending line shows the force exerted by the set of plate springs 16 as a function of the spring stroke s. The impact force F' between the axle element 15 and the collar 20 of the spring column 12, which is relatively low in the resting position, is designated by the arrow lying between the characteristic lines of the springs 14 and 16. Here, the collar 20 of the spring column 12 rests on the axle element 15. If the spring column 12 shown in FIG. 2 is pressed downwards by a loading of the holding device 5, e.g., by a web of paper 6, then the force generated by the compression spring 14 increases, whereby this force counteracts the force generated by the set of plate springs 16 until the set of plate springs 16 is completely released at the spring stroke $s_0$.

Figure 5:
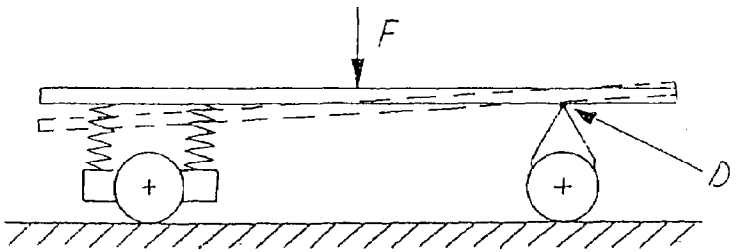
FIG. 5 is a schematic view of a shifting platform according to the present invention in an alternative embodiment.

FIG. 5 shows schematically another, alternative embodiment of a shifting platform according to the present invention. According to the embodiment shown in FIG. 5, the shifting platform is only partly spring-loaded on the left side and, on the right side, lies in a non-spring-loaded manner on a point of rotation or pivot bearing. A force F generated, e.g., by a web of paper acts on the shifting platform and is absorbed by the spring or springs arranged on the left side, whereby the spring or springs may be likewise designed, as described above, as first and second spring elements or even as a single or a plurality of spring elements, which have a varying spring extension constant over their spring stroke, such that the force F occurring is advantageously "soft" spring-loaded over a preferably relatively small initial spring stroke, while, after this relatively small spring stroke, a higher spring force counteracts a further lowering of the upper side of the shifting platform.

Figure 6:
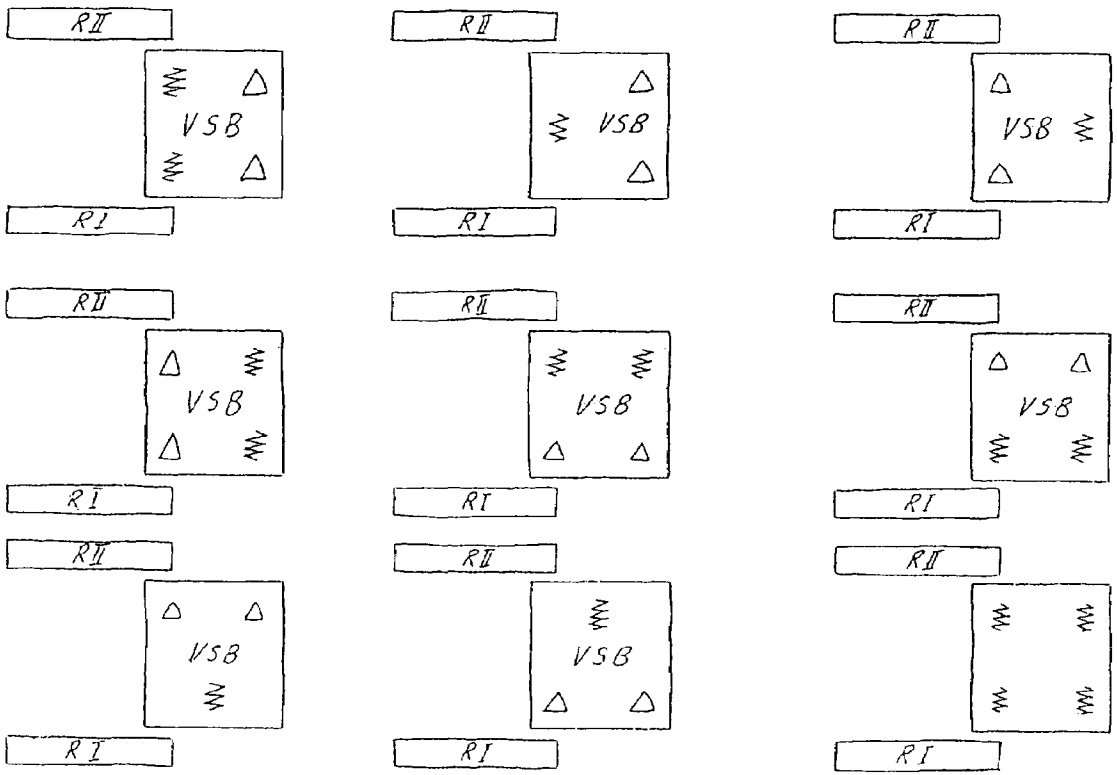
FIG. 6 is a view of other alternative embodiments of a shifting platform according to the present invention.

FIG. 6 shows other alternative embodiments of the present invention in schematic view. A first, e.g., left side of a web changer is designated by RI and a second, e.g., right side of a web changer is designated by RIJ. The shifting platform is designated by VSB. The point of rotation of the frame is schematically shown by a triangle, and the spring or springs, spring elements or sets of springs used are shown by zigzag lines.

As can be seen from FIG. 6, the shifting platform can be rotatably mounted, e.g., at one, two or more points and be spring-loaded at one, two or more points. The embodiment shown at the right bottom in FIG. 6 corresponds to the embodiment especially described with reference to FIG. 2.

Other arrangements of points of rotation or pivot bearings and spring element(s) will be familiar to a person skilled in the art, even if these are not explicitly schematically shown in FIG. 6.

While specific embodiments of the invention have been shown and described in detail to illustrate the application of the principles of the invention, it will be understood that the invention may be embodied otherwise without departing from such principles.

What is claimed is:

1. A web supporting device for supporting a web, the supporting device comprising:

a holding device;

a first spring element generating a first spring force on the holding device directed generally against the force caused by the load in case of a loading of said holding device; and a second spring element generating a second spring force on the holding device acting generally in the direction of the force caused by the loading of said holding device.

2. A device in accordance with claim 1, whereby the maximum spring stroke of said second spring element is less than a maximum spring stroke of said first spring element.

3. A device in accordance with claim 1, wherein said second spring element is completely released after a predetermined spring stroke.

4. A device in accordance with claim 1, wherein a spring extension constant of said first spring element is greater than, equal to or less than a spring extension constant of said second spring element.

5. A device in accordance with claim 1, wherein said first spring element is a compression spring and/or said second spring element is a plate spring or a set of plate springs.

6. A device in accordance with claim 1, further comprising a switch triggered when said holding device is loaded.

7. A process for spring-loading a web during a removal of the web, the process comprising:

placing a web onto a holding device;

pressing via the holding device, along a predetermined spring stroke, against the force of at least one first spring element and with the force of a second spring element whereby the web, after the predetermined spring stroke, only presses against the force of the first spring element.

8. A process in accordance with claim 7, wherein a switching signal is generated after a predeterminable spring stroke.

* * * * *